US010604899B2

(12) United States Patent
Horii et al.

(10) Patent No.: US 10,604,899 B2
(45) Date of Patent: Mar. 31, 2020

(54) RAIL INSPECTION DEVICE AND RAIL INSPECTION SYSTEM

(71) Applicant: Daifuku Co., Ltd., Osaka-shi (JP)

(72) Inventors: Takahiro Horii, Hinocho (JP); Yoshihiro Nakano, Hinocho (JP)

(73) Assignee: Daifuku Co., Ltd., Osaka-shi (JP)

( * ) Notice: Subject to any disclaimer, the term of this patent is extended or adjusted under 35 U.S.C. 154(b) by 205 days.

(21) Appl. No.: 15/729,946

(22) Filed: Oct. 11, 2017

(65) Prior Publication Data

US 2018/0100274 A1 Apr. 12, 2018

(30) Foreign Application Priority Data

Oct. 12, 2016 (JP) ..... 2016-201209

(51) Int. Cl.
*E01B 35/04* (2006.01)
*B61B 3/02* (2006.01)
*B61K 9/08* (2006.01)

(52) U.S. Cl.
CPC ..... *E01B 35/04* (2013.01); *B61B 3/02* (2013.01); *B61K 9/08* (2013.01)

(58) Field of Classification Search
CPC ..... E01B 35/04; B61B 3/02; B61K 9/08
USPC ..... 73/146
See application file for complete search history.

(56) References Cited

U.S. PATENT DOCUMENTS 5,094,004 A * 3/1992 Wooten ..... E01B 35/04 33/338
5,351,411 A * 10/1994 Gronskov ..... B61K 9/12 33/1 Q
9,963,157 B2 * 5/2018 Michitsuji ..... G01B 21/04
2010/0242783 A1 * 9/2010 Oguro ..... B65G 37/02 104/91
2012/0312188 A1 * 12/2012 Inui ..... B60L 5/005 104/288
2015/0353104 A1 * 12/2015 Maeyama ..... B61B 13/00 701/19
2016/0194013 A1 * 7/2016 Michitsuji ..... G01B 21/04 73/146
2017/0008540 A1 1/2017 Onda et al.

FOREIGN PATENT DOCUMENTS

JP 2005299110 A 10/2005
JP 2006290177 A 10/2006
JP 201226183 A 2/2012
JP 2015170299 A 9/2015

OTHER PUBLICATIONS

Wisconsin DOT, Standard Specifications for Jointed Railroad Track Construction and Maintenance, Mar. 2012 (Year: 2012).*

* cited by examiner

*Primary Examiner* — Natalie Huls
*Assistant Examiner* — Jermaine L Jenkins
(74) *Attorney, Agent, or Firm* — The Webb Law Firm

(57) ABSTRACT

A rail inspection device comprises a carriage having wheels, a first roller in contact with a side surface of a first rail, a second roller in contact with a side surface of a second rail, a first position sensor configured to detect a position of a side surface of the first rail or an outer surface of the first roller, a second position sensor configured to detect a position of a side surface of the second rail or an outer surface of the second roller, and at least one rotation sensor each configured to detect a rotation angle of a wheel, the first roller, or the second roller.

7 Claims, 8 Drawing Sheets

RAIL INSPECTION DEVICE AND RAIL INSPECTION SYSTEM

CROSS-REFERENCE TO RELATED APPLICATION

This application claims priority to Japanese Patent Application No. 2016-201209 filed Oct. 12, 2016, the disclosure of which is hereby incorporated in its entirety by reference.

FIELD OF THE INVENTION

The present invention relates to a rail inspection device and a rail inspection system.

BACKGROUND ART

Ceiling or overhead transport vehicles which are sometimes used in, for example, an article transport facility transport articles by traveling along a pair of travel rails and a guide rail installed above the travel rails. In such an article transport facility, oscillations may occur in ceiling transport vehicles during traveling if the travel rails or the guide rail are not installed properly. Therefore, it is important to have the travel rails and the guide rail properly installed. To this end, it is preferable that the installed state of the rails can be inspected simply and reliably. A rail inspection device used for this purpose is disclosed in, for example, JP Publication of Application No. 2006-290177 (Patent Document 1).

The rail inspection device of Patent Document 1 is configured to detect the size of any step at a joint of two travel rail segments which are adjacent and lined up against each other along the direction in which the rail extends (an example of a installed state of a first rail and a second rail). More specifically, a laser range finder is provided in a travel carriage of the ceiling transport vehicle which travels along the travel rails. And the vertical distance from the travel carriage to a travel rail is measured by this laser range finder. However, while it is important for each travel rail to extend continuously without a step at joints, it is equally important for the pair of travel rails to have a proper spacing between them and for the guide rail to have a proper positional relationship with a travel rail.

Conventionally, in order to inspect whether a guide rail has a proper positional relationship with a travel rail, the distance along the lateral width direction between the travel rail and the guide rail is measured using an inspection jig that includes a depth gauge as shown in FIG. 12. More specifically, to measure the distance between the travel rail and the guide rail, a worker presses one end of the L-shaped inspection jig against the guide rail and measures the "depth" to the travel rail with the depth gauge attached to the other end. This method involving such manual operation is not only inefficient, but also depends highly on the worker's skill to take measurements, making it more likely to have variations in accuracy in the inspection.

SUMMARY OF THE INVENTION

A rail inspection device is desired with which an installed state of a first rail and a second rail along a lateral width direction can be inspected efficiently and with a constant level of accuracy without having to depend on a worker.

A rail inspection device in accordance with the present disclosure and configured to inspect an installed state of a first rail and a second rail, the rail inspection device comprising: a carriage having wheels and configured to travel along the first rail and the second rail that are located at different positions along a lateral width direction; a first roller supported by the carriage to be smoothly movable along the lateral width direction and configured to roll in contact with a side surface of the first rail; a second roller supported by the carriage to be smoothly movable along the lateral width direction and configured to roll in contact with a side surface of the second rail; a first position sensor fixedly mounted to the carriage and configured to detect a position, along the lateral width direction, of one of a side surface of the first rail and an outer surface of the first roller; a second position sensor fixedly mounted to the carriage and configured to detect a position, along the lateral width direction, of one of a side surface of the second rail and an outer surface of the second roller; and at least one rotation sensor provided to the carriage and each configured to detect a rotation angle of one of (a) one of the wheels, (b) the first roller, and (c) the second roller.

With this arrangement, a rail inspection device is formed by providing the first position sensor, the second position sensor, and the rotation sensor to the carriage that includes the first roller and the second roller and that has a structure similar to a travel carriage of a common ceiling or overhead transport vehicle. The positions, along the lateral width direction, of the side surfaces of the first rail or the second rail can be obtained easily with the first position sensor and the second position sensor simply by causing the rail inspection device that is designed to be similar to a travel carriage of such a common ceiling transport vehicle to travel along the first rail and the second rail. And the distance between the first rail and the second rail along the lateral width direction can be calculated, as the installed state of the first rail and the second rail, from the positions of the side surfaces of the first rail and the second rail along the lateral width direction. In addition, by measuring the rotation angle of one of (a) one of the wheels, (b) the first roller, and (c) the second roller with at least one rotation sensor, the position along the rail extending direction can be calculated from the rotation angle. And the position along the rail extending direction, and the distance between the first rail and the second rail along the lateral width direction can be associated with each other. Therefore, the lateral distance (distance along the lateral width direction) between the first rail and the second rail at any position along the rail extending direction can be continuously measured in a relatively short period of time. Thus, inspection efficiency can be improved. Because the inspection only requires causing the rail inspection device to travel along the first rail and the second rail with very little dependency on a worker's measurement skills, a constant level of inspection accuracy can be maintained without having to rely on a worker.

Additional features and advantages of the technology disclosed herein will be further clarified by the following description of exemplary and non-limiting embodiments described with reference to the attached drawings.

DETAILED DESCRIPTION

Figure 1:
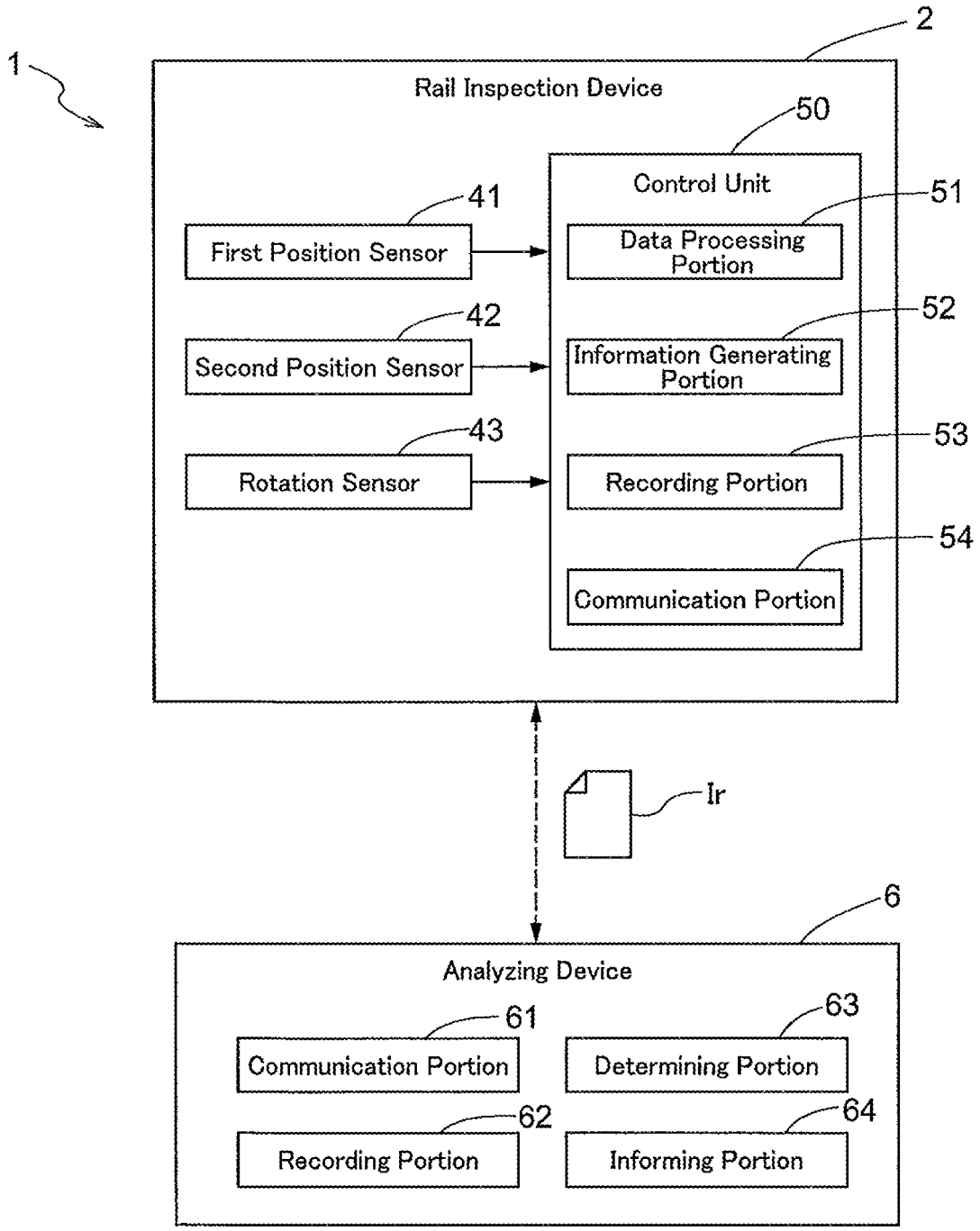
FIG. 1 is a block diagram showing a control-related arrangement of a rail inspection system in accordance with an embodiment.

Embodiments of a rail inspection device and a rail inspection system that uses the rail inspection device are described with reference to the attached drawings. In the present embodiment, an example is described in which a rail inspection system 1 and a rail inspection device 2 for inspecting an installed state of a travel rail 91 and a guide rail 92 installed in an article transport facility 9 provided in a clean room of, for example, a semiconductor substrates processing factory, etc.

As shown in FIG. 1, the rail inspection system 1 of the present embodiment includes a rail inspection device 2, and an analyzing device 6 which is signally connected to the rail inspection device 2 for exchanging information. The rail inspection device 2 is configured to travel along the travel rails 91 and the guide rail 92 to obtain data, and to transmit the obtained data (inspection result information Ir described below) to the analyzing device 6. The analyzing device 6 determines the presence or non-presence of an abnormal condition in the installed state of the travel rails 91 and the guide rail 92 as well as the nature of the abnormality if any abnormal condition exists, based on the received inspection result information Ir.

Figure 2:
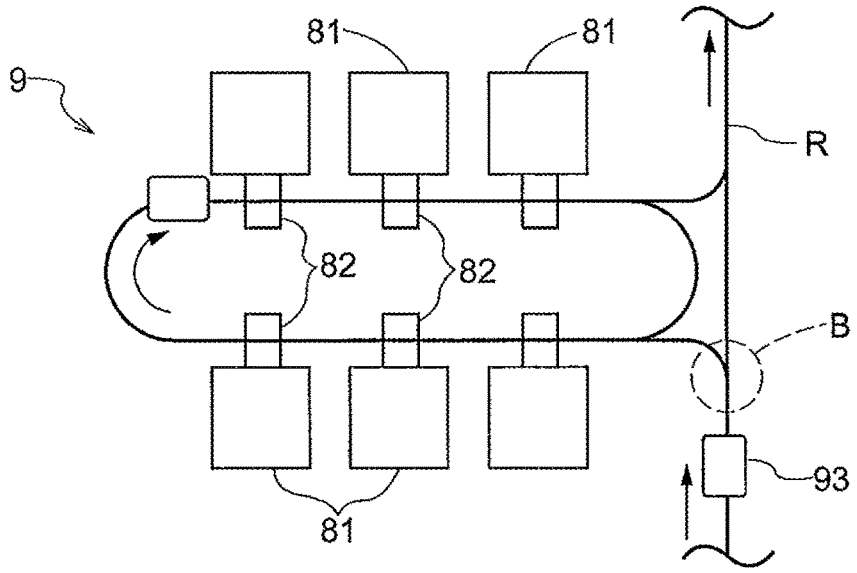
FIG. 2 is a schematic diagram showing transporting paths in an article transport facility.
Figure 3:
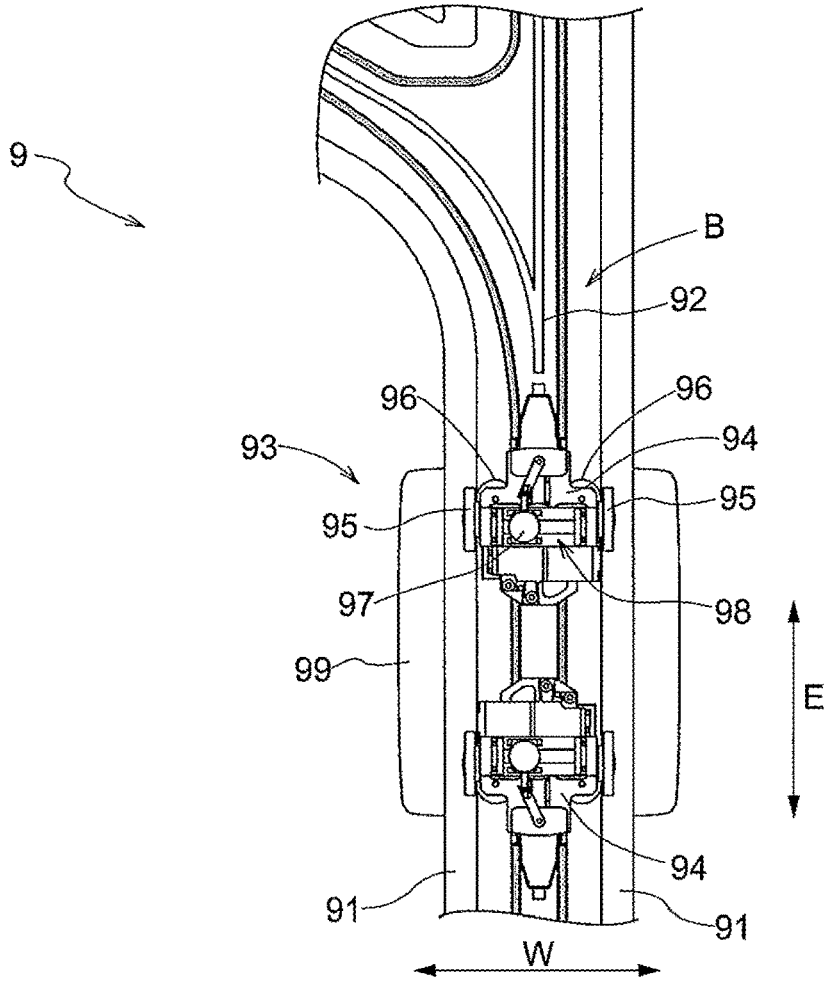
FIG. 3 is a plan view of an article transport device.
Figure 4:
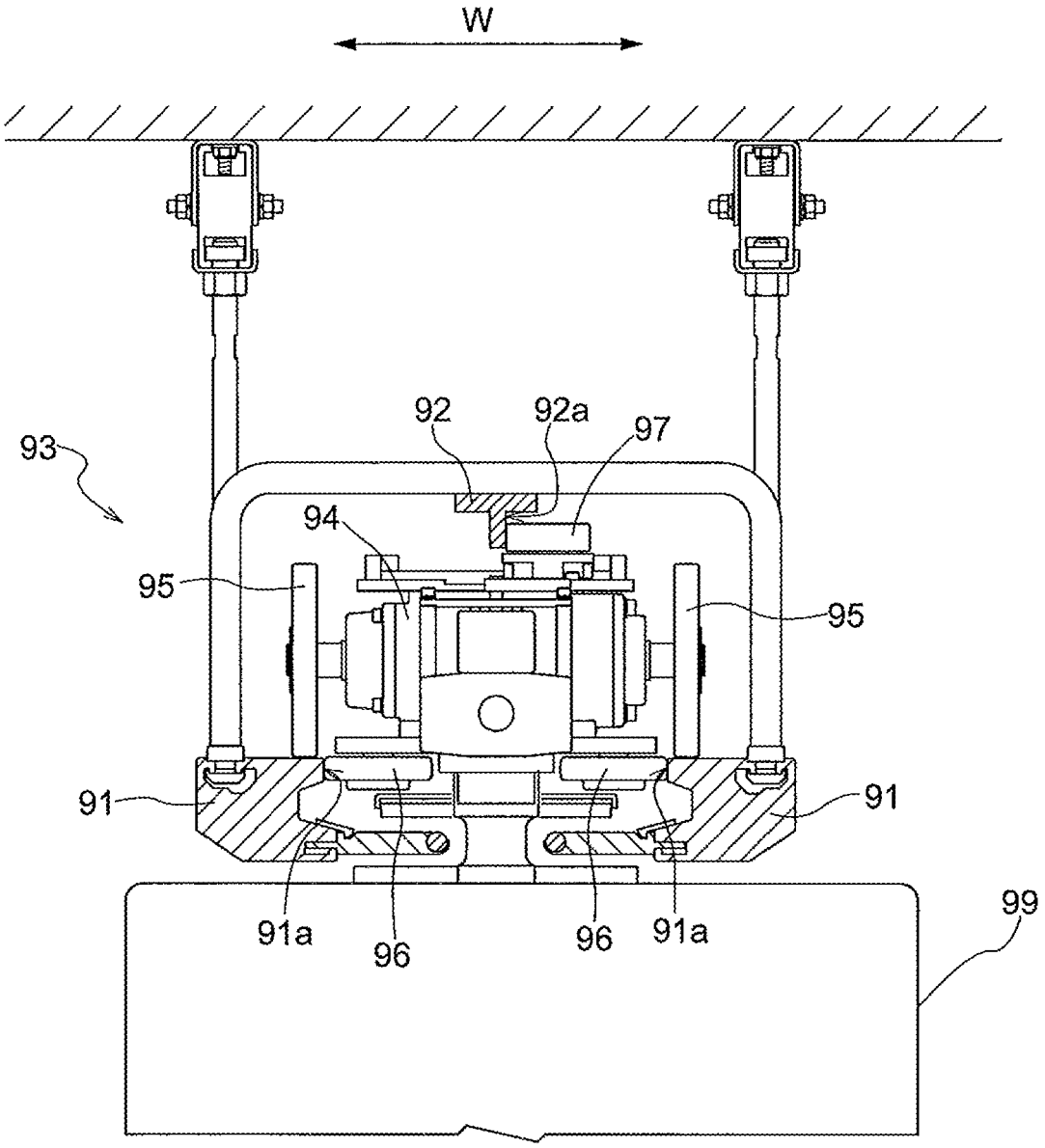
FIG. 4 is a front view of the article transport device.

As shown in FIGS. 2-4, the article transport facility 9 includes pairs of right and left travel rails 91 provided along transporting paths R, and ceiling or overhead transport vehicles 93 each of which is configured to travel along the travel rails 91 to transport articles, one article at a time. A transporting path R (a travel path for the ceiling transport vehicles 93) is generally formed in a loop which extends by way of a plurality of article processors 81. In addition, while not shown, a plurality of subunits, each of which is identical, or substantially identical, to the subunit shown in FIG. 2, are connected to form a loop as a whole. Further, a plurality of units, each of which may consist of a plurality of subunits, may be connected to form a larger loop as a whole.

As shown in FIGS. 3 and 4, a guide rail 92 is installed in an area of a branching point B in a transporting path R. This guide rail 92 is installed to allow a ceiling transport vehicle 93 to change its traveling direction at the branching point B as the ceiling transport vehicle 93 travels along the travel rails 91. The guide rail 92 is installed at a higher position than the travel rails 91 at a center position, along the lateral width direction W, between the travel rails 91 that form the pair of travel rails 91. In the present embodiment, the pair of travel rails 91 are suspend from, and supported by, a ceiling. And the guide rail 92 is fixed to undersurfaces of frame members each of which has an inverted U-shape and extends between, and is connected to the top surfaces of, the pair of travel rails 9. The guide rail 92 is two-pronged or splits into two rails at the branching point B (see FIG. 3).

Each ceiling transport vehicle 93 includes a travel carriage 94, wheels 95, side rollers 96, guide rollers 97, a switching mechanism 98, and a transfer unit 99. The travel carriage 94 rotatably supports the wheels 95, the side rollers 96, and the guide rollers 97. A plurality of the wheels 95 are divided equally to the right and left sides of the ceiling transport vehicle 93, and roll on the top surfaces of the travel rails 91. At least one of the plurality of wheels 95 is a driven wheel which is driven and rotated by an actuating motor, and provides a propelling force to the ceiling transport vehicle 93. A plurality of side rollers 96 are divided equally to the right and left sides, and roll on, and in contact with, side surfaces 91*a* of the travel rails 91. Each guide roller 97 is so configured that its position along the lateral width direction W can be changed by the switching mechanism 98, and that it rolls on, and in contact with, one of the side surfaces 92*a* of the guide rail 92 depending on its position along the lateral width direction.

In the present embodiment, two travel carriages 94 (each having a pair of right and left wheels 95, and two side rollers 96 forming a right-hand set of side rollers 96 and two side rollers 96 forming a left-hand set of side rollers 96) are connected to the transfer unit 99 at different locations along a front and back direction such that each travel carriage 94 is rotatable with respect to the transfer unit 99. The guide roller 97 and the switching mechanism 98 for the guide roller 97 are provided to at least the travel carriage 94 that is on the front side in the traveling direction.

The ceiling transport vehicles 93 travel along the transporting paths R (the travel rails 91 and the guide rail 92) to transport articles, in accordance with transport commands, for example, from a superordinate controller. For example, a ceiling transport vehicle 93 retrieves an article from a storage section (not shown) which is the transport origin (location from which the article is transported) specified by a transport command, and transports the article to a support platform 82 provided next to a processor 81 which is the transport destination (location to which the article is transported) specified by the transport command. Each article may be, for example, a container (a Front Opening Unified Pod or a FOUP for short) configured to hold one or more semiconductor substrates, among other possibilities.

For example, in the example shown in FIG. 2, suppose that the ceiling transport vehicle 93 shown near the lower right corner is transporting an article to one of the support platforms 82 shown in the drawing, then the switching mechanism 98 moves the guide roller 97 to a position on the traveling direction side (i.e., left hand side) at the branching point B. In this way, the guide roller 97 rolls on, and in contact with, the side surface 92*a* on the traveling direction side (left hand side) of the guide rail 92 to direct the ceiling transport vehicle 93 to the support platform 82 that is the transport destination.

Here, the pair of travel rails 91 and the guide rail 92 needs to be properly installed. More specifically, the travel rails 91 and the guide rail 92 need to be manufactured or formed with high accuracy and also need to be installed with high accuracy. This is because oscillations will occur in the ceiling transport vehicles 93 during the traveling if the installed state of the travel rails 91 and/or the guide rail 92 is not good. The oscillations tends to occur in a ceiling transport vehicle 93 especially at a branching point B where the ceiling transport vehicle 93 travels while turning with the guide roller 97 rolling on, and in contact with, a side surface 92*a* of the guide rail 92.

The rail inspection system 1 and the rail inspection device 2 of the present embodiment are configured, as described below, to be capable of inspecting the installed state of the travel rails 91 and the guide rail 92 efficiently and with a constant level of accuracy without having to depend on measurement taking skills of a worker.

Figure 5:
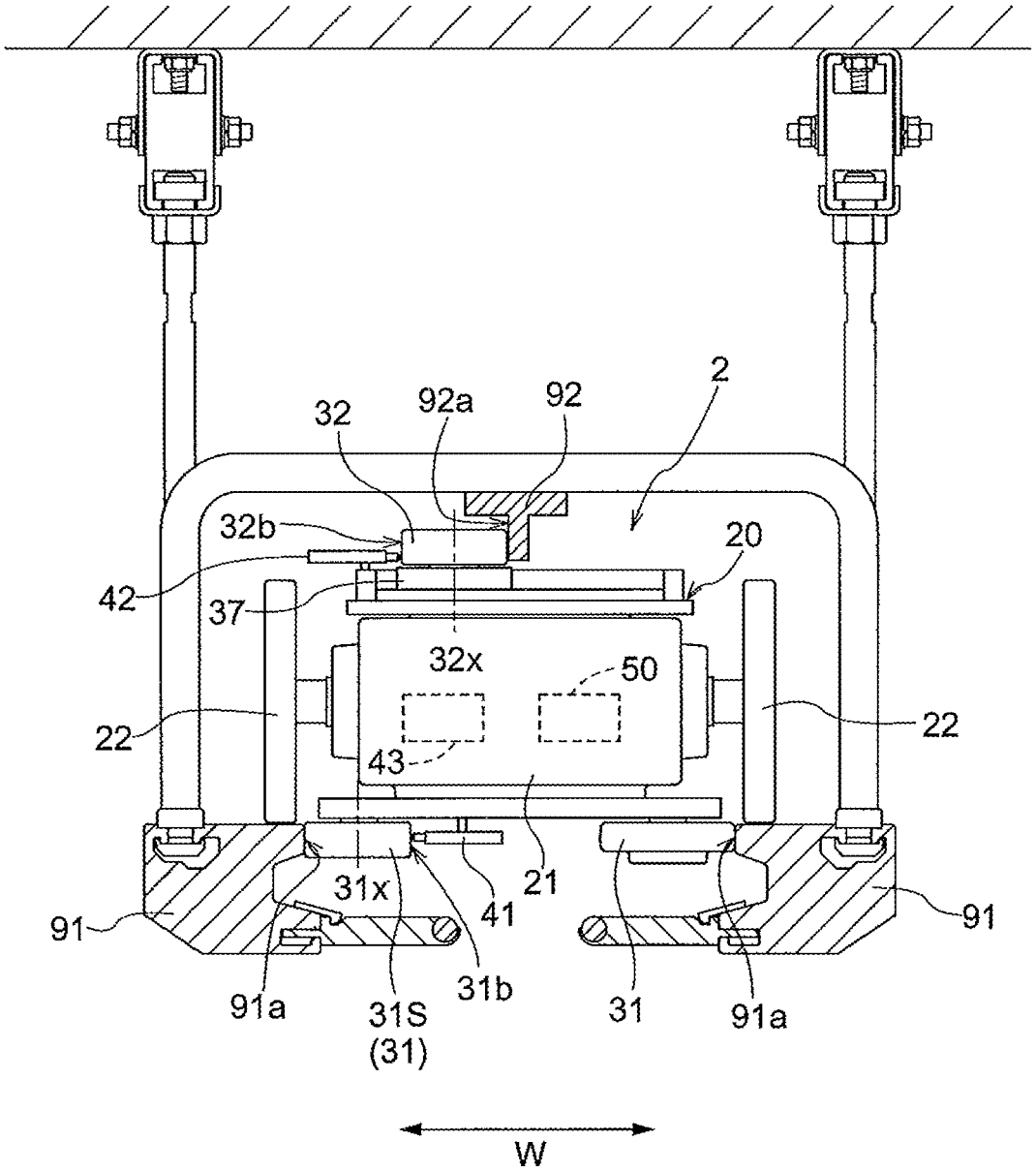
FIG. 5 is a front view of a rail inspection device.
Figure 6:
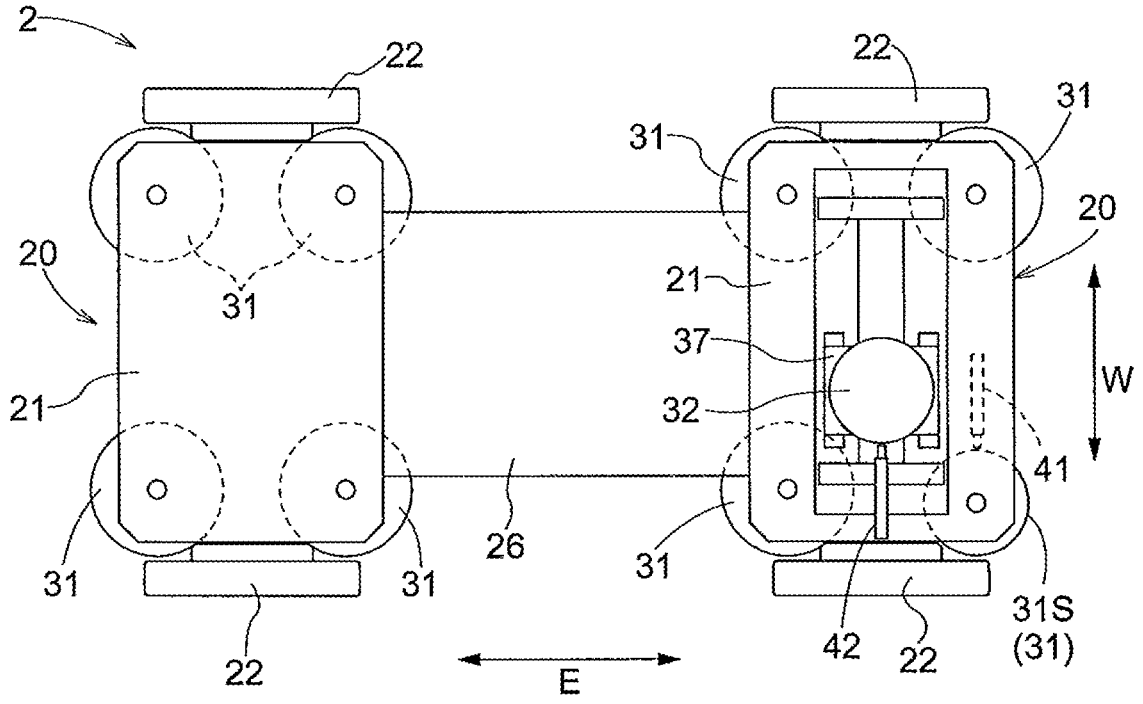
FIG. 6 is a plan view of the rail inspection device.
Figure 7:
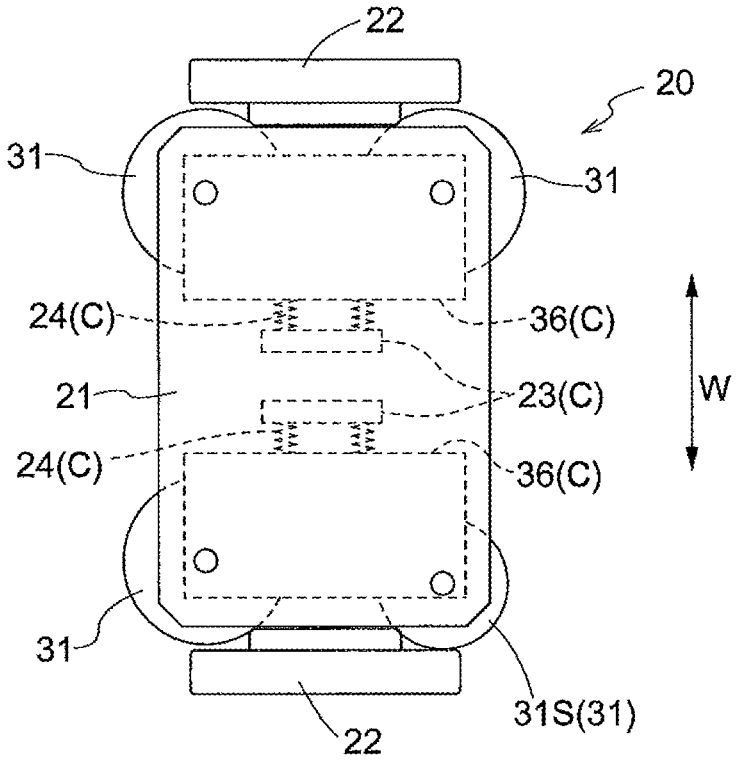
FIG. 7 is a diagram showing the internal structure of the rail inspection device.

As described above, the rail inspection system 1 includes a rail inspection device 2, and an analyzing device 6 which are signally connected to each other for exchanging information. As shown in FIGS. 5-7, the rail inspection device 2 includes, as its major hardware components, two carriages 20 with wheels 22, first rollers 31, a second roller 32, a first position sensor 41, a second position sensor 42, at least one rotation sensor 43, and a control unit 50. In addition, as shown in FIG. 1, the rail inspection device 2 includes, as its major software components of the control unit 50, a data processing portion 51, a information generating portion 52, a recording portion 53, and a communication portion 54.

Each carriage 20 has a carriage main body 21 and a pair of right and left wheels 22 rotatably supported by this carriage main body 21. The wheels 22 of each carriage 20 are supported to be rotatable about a rotation axis which extends along the lateral width direction W. The wheels 22 roll on respective ones of the pair of travel rails 91 which are installed to be spaced apart from each other along the lateral width direction W. In the present embodiment, each wheel 22 is a non-driven freely rotatable wheel rotatable on the travel rail 91; thus, the carriages 20 are of a non-self-propelling type. The carriages 20 (the rail inspection device 2) may be configured to travel along the travel rail 91 by being pushed or pulled by a worker. Note that the rail inspection device 2 of the present embodiment is provided with two carriages 20 each of which has a pair of wheels 22. And these carriages 20 are rotatably connected to a connecting member 26 at respective positions that are spaced apart from each other along the front and back direction.

Each of the first rollers 31 is supported by a carriage 20 (more specifically by a carriage main body 21), and rolls on, and in contact with, a side surface 91*a* of a travel rail 91. In the present embodiment, one of the travel rails 91 forming the pair is, or corresponds to, the "first rail". Each first roller 31 is rotatably supported by a carriage main body 21 to be rotatable about a rotation axis 31*x* extending along a vertical direction. In the present embodiment, each carriage 20 has four first rollers 31 with two sets of first rollers with each set consisting of two first rollers 31 and with one set located on the right hand side of the carriage 20 and the other set located on the left hand side. As shown in FIG. 7, on each of the right hand side and left hand side, the two first rollers 31 forming a set are rotatably supported by a common base platform 36 in a carriage main body 21. Each base platform 36 is configured to be slidable, or smoothly movable (i.e., capable of being moved smoothly), along the lateral width direction W. As such, the first rollers 31 are supported to be slidable, or smoothly movable, along the lateral width direction W through the base platform 36.

Each base platform 36 is urged outward along the lateral width direction W (i.e. toward the corresponding travel rail 91) by urging means 24 which is interposed between the base platform 36 and a support member 23 of the carriage main body 21. Because of this arrangement, the first rollers 31 roll while always in contact with the side surfaces 91*a* (i.e., inward surfaces) of the pair of travel rails 91 that face each other. The urging means 24 may be, for example, one or more springs, or rubber material, etc., in a compressed state. The carriage 20 is centered with respect to the center position between the pair of travel rails 91 along the lateral width direction W by the urging forces of the urging means 24 on the right hand side and the left hand side. In the present embodiment, a centering mechanism C is formed by the support members 23, the urging means 24, and the base platforms 36 which are provided to a carriage 20.

In addition, in the present embodiment, three of the four first rollers 31 may be identical to the side rollers 96 provided in a ceiling transport vehicle 93. The remaining one first roller 31 is preferably a specific roller 31S which is a roller-shaped contacting member which is manufactured with high precision. When the outer diameter of the specific roller 31S differs from the outer diameter of other first rollers 31, it would be preferable to adjust the mounting position of the specific roller 31S such that the four first roller 31 including the specific roller 31S all contact the corresponding side surfaces 91*a* of the travel rails 91 simultaneously, taking the difference in the diameter into consideration.

Each second roller 32 is supported by a carriage 20 (more specifically carriage main body 21), and rolls on, and in contact with, a side surface 92*a* of the guide rail 92. In the present embodiment, the guide rail 92 is, or correspond to, the "second rail". Each second roller 32 is supported by a support platform 37 of the carriage main body 21 to be rotatable about a rotation axis 32*x* extending along the vertical direction. In the present embodiment, a single second roller 32 is provided to only one of the carriages at a position offset to one side of a center position along the lateral width direction W. The support platform 37 can be slidable, or smoothly movable, along the lateral width direction W. In this way, the second roller 32 is supported to be slidable, or smoothly movable (i.e., capable of being moved smoothly), along the lateral width direction W through the support platform 37. While detailed description is omitted here, the support platform 37 is urged toward a center position (toward the guide rail 92) along the lateral width direction W. This arrangement causes the second roller 32 to be always in contact with a side surface 92*a* of the guide rail 92. The second roller 32 is preferably a roller-shaped contact member that is manufactured with high precision.

The first position sensor 41 is fixedly mounted to the carriage 20 (more specifically, to the carriage main body 21), and detects or measures the position, along the lateral width direction W, of the outer surface 31*b* of one of the plurality of first rollers 31 (more specifically, the specific roller 31S), in the present embodiment. In the present embodiment, a contact-type position sensor is used as the first position sensor 41. The primary function of the first position sensor 41 is to detect or measure the amount of displacement of the sensor head that is in contact with the outer surface 31*b* of the specific roller 31S as the object of detection or measurement. Provided that a reference position of the sensor head is known, the position of the outer surface 31*b* of the specific roller 31S along the lateral width direction can also be calculated by adding the amount of displacement of the sensor head to the reference position. Therefore, in the present embodiment, this position along the lateral width direction which can be directly calculated based on the amount of displacement of the portion (here the outer surface 31*b* of the specific roller 31S) which the sensor head is in direct contact with is also considered to be "detected" or "measured" by the first position sensor 41.

Figure 12:
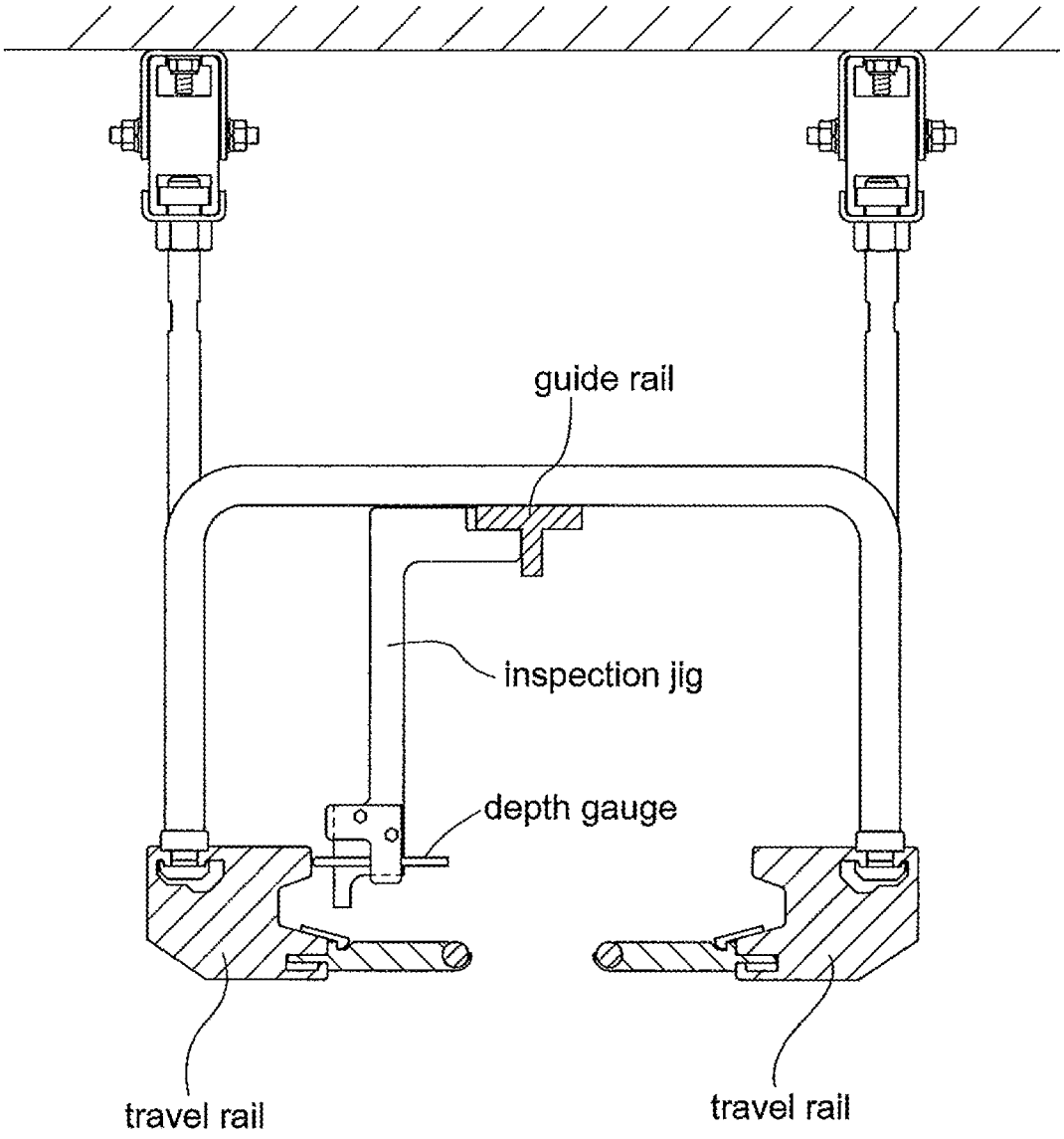
Fig.12 Prior Art
FIG. 12 shows how a conventional inspection jig is used.

In the present embodiment, the first position sensor 41 is so positioned that its sensor head is in contact with a portion of the outer surface 31*b* that is on the opposite side of the rotation axis 31*x* (i.e., 180 degrees) from the location of contact between the specific roller 31S the travel rail 91. With such an arrangement, the first position sensor 41 detects or measures the position along the lateral width direction W of the portion (of the outer surface 31*b* of the specific roller 31S) that is closest to the guide rail 92 along the lateral width direction W (i.e., as seen along the vertical direction). The positional resolution of the first position sensor 41 is about 0.01 mm, for example, and a position can be detected or measured with high precision, with the measured values accurate to the tens of microns. Note that accuracies in the order of 100 microns are the limit for measurements taken with a conventional inspection jig (see FIG. 12) and that it is possible to improve measurement accuracy substantially (by a factor of about 10) with the present invention compared with the conventional technology.

The second position sensor 42 is fixedly mounted to the carriage 20 (more specifically, to the carriage main body 21), and detects or measures the position of the outer surface 32*b* of the second roller 32 along the lateral width direction W, in the present embodiment. In the present embodiment, a contact-type position sensor is used as the second position sensor 42 as with the first position sensor 41. The primary function of the second position sensor 42 is to detect or measure the amount of displacement of its sensor head that is in contact with the outer surface 32*b* of the second roller 32 as the object of detection or measurement. Provided that a reference position of the sensor head is known, the position of the outer surface 32*b* of the second roller 32 along the lateral width direction can also be calculated by adding the amount of displacement of the sensor head to the reference position. Therefore, in the present embodiment, this position along the lateral width direction which can be directly calculated based on the amount of displacement of the portion (here the outer surface 32*b* of the second roller 32) which the sensor head is in direct contact with is also considered to be "detected" or "measured" by the second position sensor 42.

In the present embodiment, the second position sensor 42 is so positioned that its sensor head is in contact with a portion of the outer surface 32*b* that is on the opposite side of the rotation axis 32*x* of the second roller 32 (i.e., 180 degrees) from the location of contact between the second roller 32 the guide rail 92. With such an arrangement, the second position sensor 42 detects or measure the position along the lateral width direction W of the portion (of the outer surface 32*b* of the second roller 32) that is closest to one of the travel rails 91 along the lateral width direction W (i.e., as seen along the vertical direction). The positional resolution of the second position sensor 42 is also about 0.01 mm, and a position can be detected with high precision, with the measured values accurate to the tens of microns.

A rotation sensor 43 is provided to the carriage 20 (more specifically, to the carriage main body 21), and detects or measure a rotation angle of at least one of the wheels 22, the first rollers 31, and the second roller 32. Since each of the wheels 22, the first rollers 31, and the second roller 32 rolled on, and is always in contact with, a travel rail 91 or the guide rail 92 in the present embodiment, any one of them can be the object of detection or measurement of rotation angle. Alternatively, two or more of the wheels 22, the first rollers 31, and the second roller 32 may be the objects of detection or measurement of rotation angle. In such a case, the corresponding number of rotation sensors 43 would be provided. Each such rotation sensor 43 may be a rotary encoder, or a resolver, for example, among other possibilities.

The control unit 50 is a unit which performs various kinds of arithmetic operations, and includes an arithmetic processing unit, such as a CPU (Central Processing Unit) and a PLC (Programmable Logic Controller). The control unit 50 configured to be capable of receiving detection information detected or measured by each of the first position sensor 41, the second position sensor 42, and the one or more rotation sensors 43. The data processing portion 51, the information generating portion 52, the recording portion 53, and the communication portion 54, each of which is a part of the control unit 50, is configured to exchange information with each other.

The data processing portion 51 performs various kinds of data processing on the raw data (obtained data) obtained by the first position sensor 41, the second position sensor 42, and the one or more rotation sensors 43. The data processing portion 51 calculates the position of a side surface 91*a* of a travel rail 91 along the lateral width direction W based on the position of the outer surface 31*b* of the specific roller 31S along the lateral width direction W, which is data obtained by the first position sensor 41, and the known outer diameter of the specific roller 31S. In addition, the data processing portion 51 calculates the position of a side surface 92*a* of the guide rail 92 along the lateral width direction W based on the position of the outer surface 32*b* of the second roller 32 along the lateral width direction W, which is data obtained by the second position sensor 42, and the known outer diameter of the second roller 32. In addition, the data processing portion 51 calculates a lateral distance Δw (distance along the lateral width direction) between one of the travel rails 91 and the guide rail 92 based on the calculated position of the side surface 91*a* of the travel rail 91 along the lateral width direction W and the calculated position of the side surface 92*a* of the guide rail 92 along the lateral width direction W. In addition, the data processing portion 51 calculates the position of the carriage 20 along an extending direction E which is the direction along which the travel rail 91 extends, based on the rotation angle of a wheel 22, the first roller 31, or the second roller 32, which is data obtained by the rotation sensor 43, and the known outer diameter of the wheel or the roller whose rotation angle is measured and a preset reference position.

More specifically, the data processing portion 51 calculates the position of the side surface 91*a* of the travel rail 91 along the lateral width direction W to be a position that is offset outward along the lateral width direction W with respect to, or from, the position of the outer surface 31*b* of the specific roller 31S along the lateral width direction W by the distance equal to the outer diameter of the specific roller 31S. In addition, the data processing portion 51 calculates the position of the side surface 92*a* of the guide rail 92 along the lateral width direction W to be a position that is offset toward the lateral center along the lateral width direction W with respect to, or from, the position of the outer surface 32*b* of the second roller 32 along the lateral width direction W by the distance equal to the outer diameter of the second roller 32. Also, the data processing portion 51 calculates the lateral distance Δw between one of the travel rails 91 and the guide rail 92 as a difference between the position of the side surface 91*a* of the travel rail 91 along the lateral width direction W and the position of the side surface 92*a* of the guide rail 92 along the lateral width direction W. In addition, the data processing portion 51 calculates the position of the carriage 20 as a position that is offset in the traveling direction of the carriage 20 with respect to, or from, a preset reference position by the total circumferential distance which depends on the outer diameter and rotation angle of the roller or the wheel whose rotation angle is measured. Note that the calculated position of the carriage 20*a* is used in the subsequent processing and operations as position P (inspection position P) at which inspections or measurements took place.

In the present embodiment, the position of the side surface 91*a* of the travel rail 91 along the lateral width direction W which is calculated by the data processing portion 51 is an example of "processed data obtained by processing data obtained by the first position sensor 41". Similarly, the position of the side surface 92*a* of the guide rail 92 along the lateral width direction W is an example of "processed data obtained by processing data obtained by the second position sensor 42", and an inspection position P is an example of, "processed data obtained by processing data obtained by the rotation sensor 43". Further, the lateral distance Δw between a travel rail 91 and the guide rail 92 is an example of "processed data obtained by processing data obtained by the first position sensor 41 and the second position sensor 42".

The information generating portion 52 of the present embodiment generates inspection result information Ir which includes lateral distance Δw between a travel rail 91 and the guide rail 92 and inspection position P such that the lateral distance Δw and the inspection position P are associated with each other. That is, the information generating portion 52 generates inspection result information Ir as information that indicates the lateral distance Δw between the travel rail 91 and the guide rail 92 at each inspection position P along the extending direction E of the travel rail 91. Such inspection result information Ir is obtained as seamless information in which, as the inspection position P changes continuously, the lateral distance Δw also changes continuously. Note that, in the present embodiment, information on the position of the side surface 92*a* of the guide rail 92 along the lateral width direction is also included in the inspection result information Ir.

The recording portion 52 of the present embodiment records inspection result information Ir in which lateral distance Δw between a travel rail 91 and the guide rail 92 and inspection position P are associated with each other. More specifically, the recording portion 53 records inspection result information Ir as information that indicates the lateral distance Δw between the travel rail 91 and the guide rail 92 at each inspection position P along the extending direction E of the travel rail 91. The recording portion 53 may be, or include, semiconductor memory, such as flash memory, for example. When the control unit 50 includes a CPU, the recording portion 53 may be other type of semiconductor memory, such as RAM (Random Access Memory), a magnetic disc, and/or an optical disc, etc. The recording portion 53 may be configured to store the inspection result information Ir generated by the information generating portion 52 as is, for example.

The communication portion 54 is configured to be capable of communicating wirelessly with the communication portion 61 of the analyzing device 6. The communication portion 54 includes a transmission-and-reception unit in compliance with the specifications of wireless LAN, Wi-Fi, or Bluetooth, etc.

As shown in FIG. 1, the analyzing device 6 includes the communication portion 61, a recording portion 62, a determining portion 63, and an informing portion 64. The analyzing device 6 may be, or include, a personal computer, or a workstation, etc., for example. The communication portion 61 is configured to be capable of communicating wirelessly with the communication portion 54 of the rail inspection device 2. The communication portion 61 includes a transmission-and-reception unit in compliance with the same specifications as the communication portion 54 of the rail inspection device 2.

The recording portion 62 records inspection result information Ir in which the lateral distance Δw between a travel rail 91 and the guide rail 92 and an inspection position P are associated with each other. More specifically, the recording portion 62 records inspection result information Ir as information that indicates the lateral distance Δw between the travel rail 91 and the guide rail 92 at each inspection position P along the extending direction E of the travel rail 91. The recording portion 62 may be, or include, semiconductor memory, such as flash memory and RAM, a magnetic disc, and/or an optical disc, etc., for example. The recording portion 62 may be configured to store the inspection result information Ir received from the control unit 50 of the rail inspection device 2 as is, for example.

In the present embodiment, the recording portion 53 is, or corresponds to, the "recording portion" of the "rail inspection device" whereas each of the recording portions 53, 62 is, or corresponds to, a "recording portion" of the "rail inspection system".

The determining portion 63 determines a presence or non-presence of an abnormal condition in the installed state of a travel rail 91 and the guide rail 92 based on the inspection result information Ir. The determining portion 63 determines a presence of an abnormal condition of the installed state based on a graph obtained by creating a graph representing the relationship between each inspection position P and the lateral distance Δw between a travel rail 91 and the guide rail 92, based on the inspection result information Ir. For example, the determining portion 63 determines a presence or non-presence of an abnormal condition in the installed state based on a result of performing a regression analysis on a plot on a two-dimensional plane with its horizontal axis representing the inspection position P and its vertical axis representing the lateral distance Δw. More specifically, for example, the determining portion 63 may determine that the installed state is in a normal condition if the correlation coefficient in a linear regression is within a preset range close to 1 (for example, within a normal determination range of greater than or equal to 0.97 and less than or equal to 1.03) and may determine that the installed state is in an abnormal condition if the correlation coefficient falls outside the normal determination range above. In addition, the normal determination range may be suitably set depending on the required specifications etc.

Figure 8:
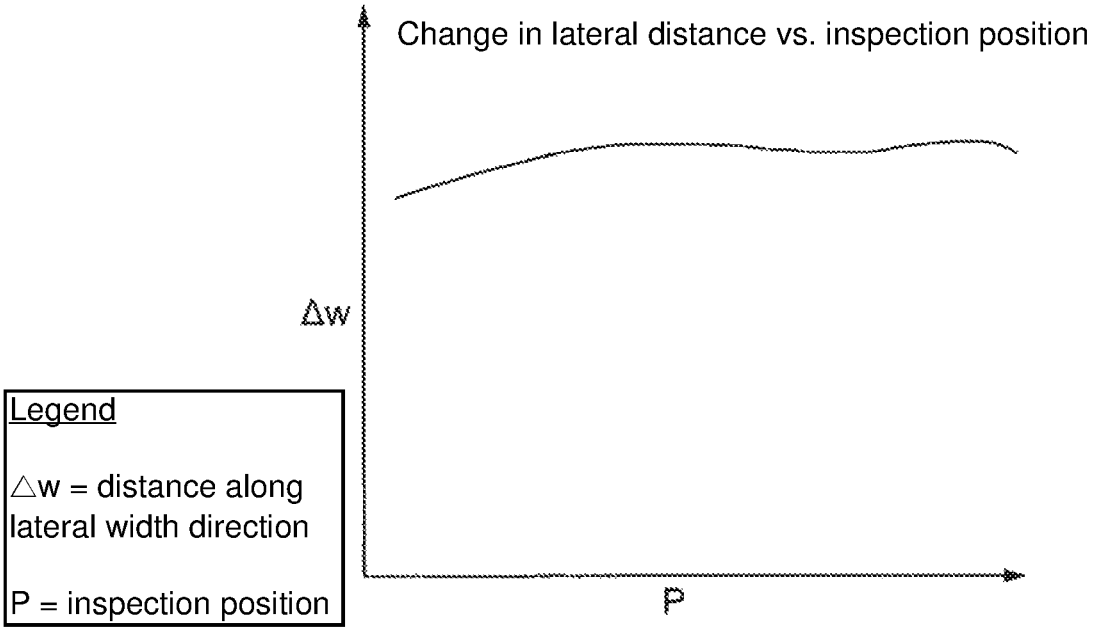
FIG. 8 is a graph showing an example of a relationship between inspection position and direction along a lateral width direction.
Figure 9:
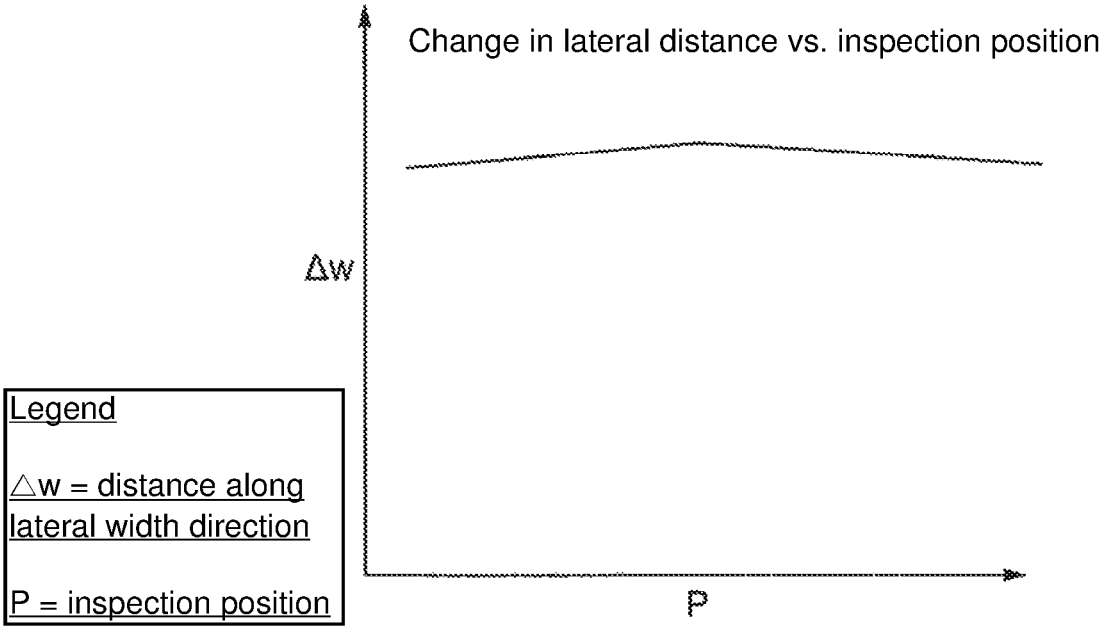
FIG. 9 is a graph showing another example of a relationship between the inspection position and the distance along the lateral width direction.

Further, in the present embodiment, when an abnormal condition of the installed state of a travel rail 91 and the guide rail 92 is determined to exit, the determining portion 63 makes a distinction between variations in the manufacturing accuracy of at least one of the travel rail 91 and the guide rail 92 and variations in the installing accuracy of the travel rail 91 and the guide rail 92 based on the graph obtained in the manner described above. When there are variations in the manufacturing accuracy of at least one of the travel rail 91 and the guide rail 92, the lateral distance Δw tends to change irregularly with respect to changes in the inspection position P as shown in FIG. 8. On the other hand, when there are variations in the installing accuracy of the travel rail 91 and the guide rail 92, the rate of change (or the slope) of the lateral distance Δw with respect to changes in the inspection position P tends to be constant up to a certain inspection point P and then tends to change to a different constant rate from that point P on, as shown in FIG. 9. Thus, the determining portion 63 makes a distinction between variations in the manufacturing accuracy and variations in the installing accuracy by distinguishing the way the lateral distance Δw changes with respect to the changes in the inspection position P.

Further, in the present embodiment, the determining portion 63 is also configured to make a simplified determination as to whether the guide rail 92 is installed at a proper position based on information on the position of the side surface 92*a* of the guide rail 92 along the lateral width direction which information is included in the inspection result information Ir. For example, the determining portion 63 makes a tentative determination that the guide rail 92 is at a proper position if the amount of displacement (detected by the second position sensor 42) of the outer surface 32*b* of the second roller 32 from a reference position is less than or equal to a reference value defined in advance, and that the guide rail 92 is not at the proper position if the amount of displacement is greater than the reference value. Such a screening function is preferably switched ON and OFF by a control switch. For example, after installing the guide rail 92, the control switch may be first turned ON to perform a screening inspection and then more detailed inspection described above may be performed on those guide rails that successfully passed the screening inspection, with the control switch turned OFF.

When it is determined that the installed state of the travel rail 91 and the guide rail 92 is in an abnormal condition, the informing portion 64 informs a worker of the presence of an abnormal condition. The informing portion 64 is connected to, for example, an image output device, such as a monitor, an audio output device, such as a loudspeaker, and/or, a light output device, such as a warning lamp, among other possibilities to inform a worker of the presence of an abnormal condition through an image, voice, or light, etc., output from one of these devices. Two or more of these devices may be used in conjunction with one another. In addition, when variations in manufacturing accuracy and variations in installing accuracy are determined to exist as two distinct kinds of variations as in the present embodiment, the informing portion 64 may use a different way to inform a worker when variations in manufacturing accuracy are detected from the way when variations in installing accuracy are detected.

In addition, when the simplified screening function described above is turned ON and the guide rail 92 is determined to be installed at an improper position, the informing portion 64 so informs a worker. When an abnormal condition is determined to exist in a screening inspection, the informing portion 64 may use yet different methods to inform a worker when variations in manufacturing accuracy and in installing accuracy.

With the rail inspection system 1 of the present embodiment, seamless inspection result information Ir can be obtained simply by causing the rail inspection device 2 to travel along the rail extending direction E. And while obtaining the inspection result information Ir, any presence or non-presence of an abnormal condition in the installed state of a travel rail 91 and the guide rail 92 can be determined efficiently based on the inspection result information Ir. At that time, a constant level of accuracy in the inspections can be maintained by the calculating operations performed by the determining portion 63, without having to depend on measurement taking skills and judging capability of a worker.

In addition, since variations in manufacturing accuracy can be distinguished from variations in installing accuracy, it becomes easy to properly determine a subsequent responsive action for an abnormality when such abnormality is determined to exist in the installed state.

By performing inspections using the rail inspection device 2 equipped with the first position sensor 41 and the second position sensor 42 each of which is of a contact-type and has a high resolution, its end result is that the travel rails 91 and the guide rail 92 can be manufactured and formed with high precision and assembled and installed with high installing accuracy. As a result, oscillations that may occur in the ceiling transport vehicle 93 at a branching point B of a transporting path R may be efficiently reduced or prevented.

Other Embodiments (1) In the embodiment described above, an example is described in which the first position sensor 41 detects or measures the position of the outer surface 31*b* of the first roller 31 (specific roller 31*s*) along the lateral width direction W whereas the second position sensor 42 detects or measures the position of the outer surface 32*b* of the second roller 32 along the lateral width direction W. However, the invention is not limited to such arrangement. For example, the first position sensor 41 may be configured to stay in contact with a side surface 91*a* of the travel rail 91 to directly detect or measures the position of the side surface 91*a* of the travel rail 91 along the lateral width direction W. Also, the second position sensor 42 may be configured to stay in contact with a side surface 92*a* of the guide rail 92 to directly detect the position of the side surface 92*a* of the guide rail 92 along the lateral width direction W. In these cases, position sensors of a noncontact type, such as laser range finders, for example, may be used as the first position sensor 41 and the second position sensor 42, if positional resolution or measurement accuracy is allowed to be lowered to some extent.

(2) In the embodiment described above, an example is described in which the carriages 20 are of a non-self-propelling type and are configured to travel by being pushed or pulled by a worker. However, the invention is not limited to such arrangement. And the carriages 20 may be configured to travel as a result of it being connected to a travel member of another vehicle of a self-propelling type, such as a travel carriage 94 of a ceiling transport vehicle 93, or a towing carriage designed specifically to tow the carriages 20, etc. Alternatively, at least one of the carriages 20 may be configured to propel itself, for example, with an actuating motor which is provided in the carriage 20 to drive and rotate at least one of the pair of wheels 22.

(3) In the embodiment described above, an example is described in which a centering mechanism C is provided in a carriage 20 to center the carriage 20 to the center position between the pair of travel rails 91 along the lateral width direction W. However, the invention is not limited to such arrangement. For example, if the screening function regarding the installed position of the guide rail 92 is not provided in the rail inspection device 2, the centering mechanism C does not necessarily need to be provided in the carriage 20.

Figure 10:
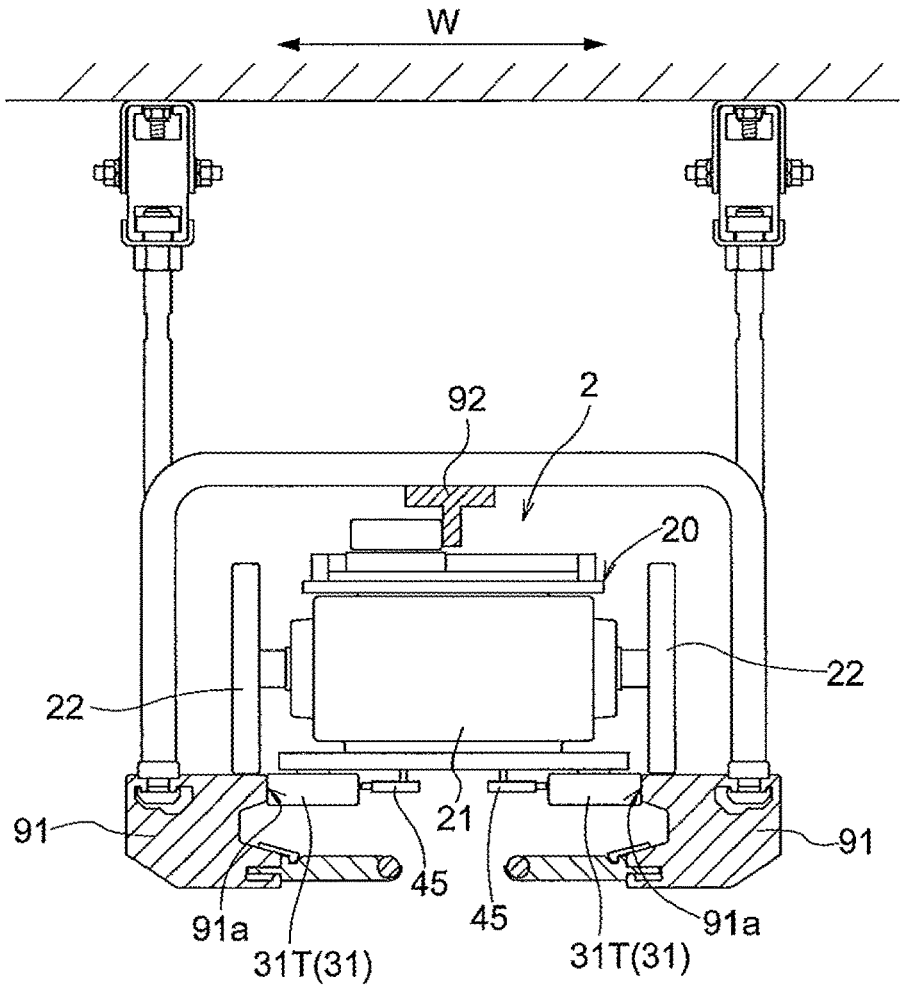
FIG. 10 is a front view of a rail inspection device in accordance with an alternative embodiment.
Figure 11:
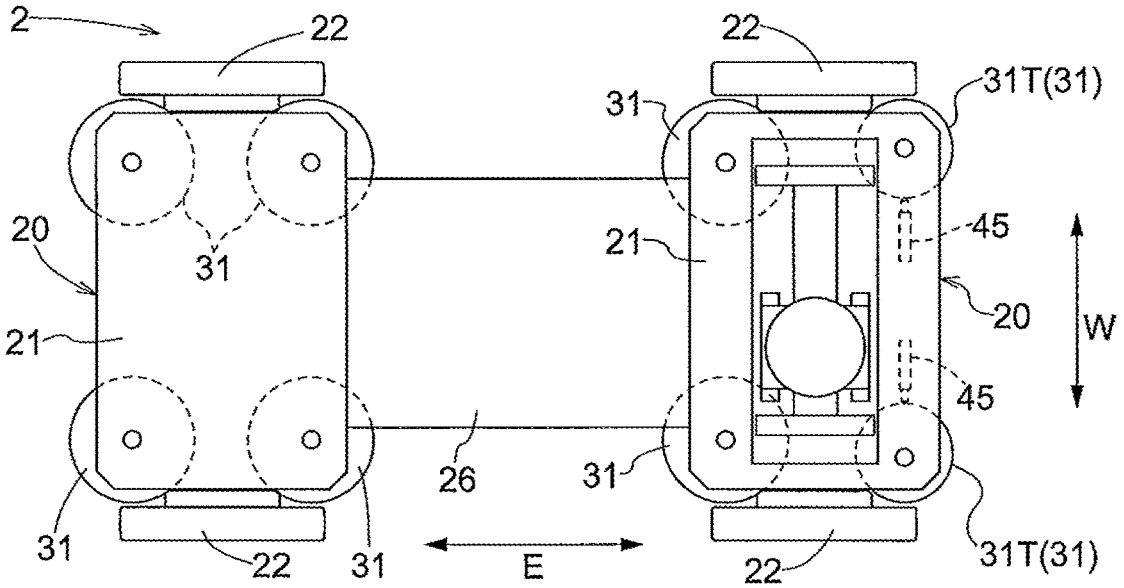
FIG. 11 is a plan view of the rail inspection device of the alternative embodiment.

(4) In the embodiment described above, an example is described in which the rail inspection system 1 and the rail inspection device 2 inspect the installed state of one of the pair of travel rails 91 and the guide rail 92. However, the invention is not limited to such arrangement. For example, the rail inspection system 1 and the rail inspection device 2 may be configured to inspect the distance W between the pair of travel rails 91 along the lateral width direction as the installed state of the travel rails 91 with respect to each other. In this case, as shown, for example, in FIGS. 10 and 11, two position sensors 45 may be installed such that the sensor head of each sensor 45 is in contact with the outer surface of the corresponding one of the two special first rollers 31 that are in contact with respective side surfaces 91*a* of the pair of travel rails 91 and that are the rollers 31T which are the objects of detection or measurements. In such an arrangement, the pair of travel rails 91 are, or correspond to, the "first rail" and the "second rail": the two rollers 31T that are objects of measurements are, or correspond to, the "first roller" and the "second roller": and the two position sensors 45 are, or correspond to, the "first position sensor" and the "second position sensor". Such rail inspection system 1 and rail inspection device 2 so arranged may be used to inspect an installed state (more specifically, lateral distance between the pair of rails) of rails in a railroad, for example.

(5) In the embodiment described above, an example is described in which, as the inspection result information Ir, the recording portion 53 records the lateral distance Δw between the travel rail 91 and the guide rail 92 obtained by processing the data obtained by the first position sensor 41 and the second position sensor 42, and the inspection position P obtained by processing the data obtained by the rotation sensor 43 such that the lateral distance Δw is associated with the inspection position P. However, the invention is not limited to such arrangement. For example, as the inspection result information Ir, the recording portion 53 may record raw data (obtained data) obtained with the first position sensor 41 and the second position sensor 42 and raw data (obtained data) obtained by the rotation sensor 43 such that these two kinds of raw data are associated with each other.

(6) The criterion described in the embodiment above for determining the presence or non-presence of an abnormal condition of the installed state of a travel rail 91 and the guide rail 92 by the determining portion 63 is only an example. The determining portion 63 may be configured to determine the presence or non-presence of an abnormal condition in the installed state in accordance with a different reference from the embodiment described above.

(7) In the embodiment described above, an example is described in which the determining portion 63 makes a distinction between variations in the manufacturing accuracy of at least one of the travel rails 91 and the guide rail 92 and variations in the installing accuracy of the travel rail 91 and the guide rail 92. However, the invention is not limited to such arrangement. And the determining portion 63 may determine only the presence or non-presence of an abnormal condition of the installed state, and does not have to be configured to make a distinction between variations in the manufacturing accuracy and variations in the installing accuracy.

(8) In the embodiment described above, the rail inspection system 1 may include a certifying portion which provides certification that it is determined that the installed state of a travel rail 91 and the guide rail 92 is normal based on the inspection result information Ir, when that determination is made. A certifying portion issues, for example, an inspection report (e.g., a certificate indicating compliance with a standard) which may state that the installed state was normal. The inspection report may, in addition, include numerical data, etc., that were used in the determination by the determining portion 63.

(9) The way each functional component of the rail inspection system 1 is allocated to either the control unit 50 or to the analyzing device 6 of the rail inspection device 2 as described above is merely an example, and is not limiting. For example, the control unit 50 may perform all functions performed by all the functional components including the determining portion 63 and the informing portion 64 so that all functions of the rail inspection system 1 may be consolidated in, and provided by, the rail inspection device 2. In addition, when, for example, the recording portion 53 of the rail inspection device 2 records raw data (obtained data) of each sensor 41, 42, or 43 such that raw data from each sensor 41, 42, or 43, are associated with each other, as the inspection result information Ir, then the data processing portion 51 and the information generating portion 52 may be provided to the analyzing device 6 so that the rail inspection device 2 only takes measurements and transmits the measurement data to the analyzing device 6, and so that all necessary calculations are performed by the analyzing device 6.

(10) Any arrangement and feature disclosed in any one embodiment described above (including the main embodiment and any alternative embodiment described above, which is true of any embodiment mentioned below) may be used in combination with any arrangement and feature disclosed in another embodiment, unless such combination gives rise to a contradiction. Regarding any arrangement, the embodiments disclosed in the present specification are presented for the sole purpose of illustrating examples with respect to all aspects of the embodiments. And it is possible to make suitable changes and modifications without departing from the spirit of the present disclosure.

Summary of Embodiments

To summarize the above, the rail inspection device and the rail inspection system in accordance with the present disclosure preferably comprises the following:

A rail inspection device configured to inspect an installed state of a first rail and a second rail, the rail inspection device comprises: a carriage having wheels and configured to travel along the first rail and the second rail that are located at different positions along a lateral width direction; a first roller supported by the carriage to be smoothly movable along the lateral width direction and configured to roll in contact with a side surface of the first rail; a second roller supported by the carriage to be smoothly movable along the lateral width direction and configured to roll in contact with a side surface of the second rail; a first position sensor fixedly mounted to the carriage and configured to detect a position, along the lateral width direction, of one of a side surface of the first rail and an outer surface of the first roller; a second position sensor fixedly mounted to the carriage and configured to detect a position, along the lateral width direction, of one of a side surface of the second rail and an outer surface of the second roller; and at least one rotation sensor provided to the carriage and each configured to detect a rotation angle of one of (a) one of the wheels, (b) the first roller, and (c) the second roller.

With this arrangement, a rail inspection device is formed by providing the first position sensor, the second position sensor, and the rotation sensor to the carriage that includes the first roller and the second roller and that has a structure similar to a travel carriage of a common ceiling or overhead transport vehicle. The positions, along the lateral width direction, of the side surfaces of the first rail or the second rail can be obtained easily with the first position sensor and the second position sensor simply by causing the rail inspection device that is designed to be similar to a travel carriage of such a common ceiling transport vehicle to travel along the first rail and the second rail. And the distance between the first rail and the second rail along the lateral width direction can be calculated, as the installed state of the first rail and the second rail, from the positions of the side surfaces of the first rail and the second rail along the lateral width direction. In addition, by measuring the rotation angle of one of (a) one of the wheels, (b) the first roller, and (c) the second roller with at least one rotation sensor, the position along the rail extending direction can be calculated from the rotation angle. And the position along the rail extending direction, and the distance between the first rail and the second rail along the lateral width direction can be associated with each other. Therefore, the lateral distance (distance along the lateral width direction) between the first rail and the second rail at any position along the rail extending direction can be continuously measured in a relatively short period of time. Thus, inspection efficiency can be improved. Because the inspection only requires causing the rail inspection device to travel along the first rail and the second rail with very little dependency on a worker's measurement skills, a constant level of inspection accuracy can be maintained without having to rely on a worker.

In one embodiment, the rail inspection device preferably further comprises a recording portion configured to record, as inspection result information, one of (a) obtained data obtained by the first position sensor and the second position sensor and (b) processed data obtained by processing the obtained data (a), and one of (c) obtained data obtained by the at least one rotation sensor and (d) processed data obtained by processing the obtained data (c), such that the obtained data (a) or the processed data (b) is associated with the obtained data (c) or the processed data (d).

With this arrangement, when the inspection result information shows a preferable result, the fact that the installed state of the first rail and the second rail is good can be objectively assured by recording such inspection result information. In addition, by recording and accumulating the inspection result information for each inspection, the accumulated inspection result information may be reviewed in an investigation to find a cause when a failure occurs in an article transport facility that may be caused by an unacceptable installed state of the first rail and the second rail. Therefore, traceability can be improved.

In one embodiment, each of the wheels preferably rolls on one of travel rails forming a pair which are installed such that the travel rails in the pair are spaced apart from each other along the lateral width direction, wherein the first rail is preferably one of the travel rails in the pair, wherein the second rail is preferably a guide rail provided at a higher position than the travel rails to allow a traveling direction of a ceiling transport vehicle that travels along the travel rails to be changed at a branching point, wherein the recording portion preferably records, as the inspection result information, information on a distance between the one of the travel rails and the guide rail along the lateral width direction at each inspection position, based on a distance between the one of the travel rails and the guide rail along the lateral width direction calculated from obtained data obtained by the first position sensor and the second position sensor and on a position of the carriage along a direction along which the travel rails extends as an inspection position calculated from obtained data obtained by the at least one rotation sensor.

With this arrangement, the lateral distance between the travel rail and the guide rail at each inspection position can be inspected with a constant level of accuracy efficiently and without depending on a worker. Therefore, the lateral distance between the travel rail and the guide rail can be maintained to be a proper distance. Oscillations tend to occur in a ceiling transport vehicle at the position of the branching point in which the guide rail is installed in an article transport facility when the lateral distance between the travel rail and the guide rail is improper. However, such oscillations can be reduced effectively by adopting an arrangement described above.

In one embodiment, each of the wheels preferably rolls on one of travel rails forming a pair which are installed such that the travel rails in the pair are spaced apart from each other along the lateral width direction, wherein the first rail is preferably one of the travel rails in the pair, wherein the second rail is preferably a guide rail provided at a higher position than the travel rails to allow a traveling direction of a ceiling transport vehicle that travels along the travel rails to be changed at a branching point, wherein a centering mechanism is preferably provided to the carriage and is configured to center the carriage with respect to a center position between the travel rails in the pair along the lateral width direction.

Generally, the installed position, along the lateral width direction, of a guide rail is often set to coincide with the center position between the pair of travel rails along the lateral width direction. In the arrangement described above, the centering mechanism is provided to the carriage of the rail inspection device, taking this standard positional relationship between the guide rail and the pair of travel rails into consideration. By adopting such a centering mechanism, it can be determined in a simplified way whether the guide rail is installed in a proper position based only on the position information of the side surface of the guide rail along the lateral width direction obtained by the second position sensor. Therefore, the rail inspection device can be used also for a simplified screening inspection after the guide rail is installed.

In one embodiment, it is preferable that the first roller is an object of detection by the first position sensor, wherein it is also preferable that the second roller is an object of detection by the second position sensor, wherein the first position sensor is preferably configured to be in contact with a portion of an outer surface of the first roller that is on an opposite side of a rotation axis of the first roller from a location of contact between the first roller and the first rail, to detect a position, along the lateral width direction, of a portion of the outer surface of the first roller that is closest to the second roller along the lateral width direction, and wherein the second position sensor is preferably configured to be in contact with a portion of an outer surface of the second roller that is on an opposite side of a rotation axis of the second roller from a location of contact between the second roller and the second rail, to detect a position, along the lateral width direction, of a portion of the outer surface of the second roller that is closest to the first roller along the lateral width direction.

With this arrangement, the position of the side surface of the first rail that is spaced apart, through the first roller, from the first position sensor by a distance equal to the outer diameter of the first roller can be properly measured using the first position sensor of a contact-type. And the position of the side surface of the second rail that is spaced apart, through the second roller, from the second position sensor by a distance equal to the outer diameter of the second roller can be properly measured using the second position sensor of a contact-type. By using contact-type sensors as the first position sensor and the second position sensor, the two points that should be measured can be clearly identified, allowing reliable position information to be obtained. In addition, although contact-type sensors are used, each sensor is so positioned to be in contact with the first roller or the second roller and not directly with the first rail or the second rail; thus, there would be no concerns about damaging the first rail or the second rail during inspection.

In one embodiment, a rail inspection system preferably comprises the rail inspection device as described above, and one or more recording portions at least one of which is configured to record, as inspection result information, one of (a) obtained data obtained by the first position sensor and the second position sensor and (b) processed data obtained by processing the obtained data (a), and one of (c) obtained data obtained by the at least one rotation sensor and (d) processed data obtained by processing the obtained data (c), such that the obtained data (a) or the processed data (b) is associated with the obtained data (c) or the processed data (d); and a determining portion configured to determine a presence or non-presence of an abnormal condition in an installed state of the first rail and the second rail based on the inspection result information.

With this arrangement, the presence or non-presence of an abnormal condition of the installed state of the first rail and the second rail can be determined efficiently based on the inspection result information simply by causing the rail inspection device to travel along the first rail and the second rail while obtaining the inspection result information. A constant level of accuracy in the inspection can be maintained by the calculating operations performed by the determining portion without having to depend on measurement taking skills and judging capability of a worker.

In one embodiment, the abnormal condition in the installed state preferably includes variations in manufacturing accuracy of at least one of the first rail and the second rail, and variations in installing accuracy of the first rail and the second rail, and wherein the determining portion preferably: obtains a graph that represents a relationship between data that originate from the at least one rotation sensor and data that originate from the first position sensor and the second position sensor, based on the inspection result information; and makes a distinction between variations in the manufacturing accuracy and variations in the installing accuracy based on a shape of the graph if it is determined that an abnormal condition exists in the installed state.

When the lateral distance between two rails is measured using, for example, the conventional inspection jig, it is possible to determine that a measured value is abnormal. However, it is difficult to determine, or to make a distinction as to, if the abnormal condition originates from error in the manufacturing of each rail or from any error in installing it. In this respect, with the arrangement described above, a distinction can be made as to if the abnormal condition originates from error in the manufacturing of each rail or from error in installing it, based on the shape of the graph that represents the relationship between the data that originate from the at least one rotation sensor and the data that originate from the first sensor and the second sensor. Therefore, when an abnormal condition is determined to exist in the installed state of the first rail and the second rail, it becomes easy to make a proper determination as to the subsequent responsive action to the abnormal condition.

What is claimed is:

1. A rail inspection device used in an article transport facility comprising: travel rails forming a pair which are installed such that the travel rails in the pair are spaced apart from each other along the lateral width direction; a ceiling transport vehicle that travels along the travel rails; and a guide rail provided at a higher position than the travel rails to allow a travelling direction of the ceiling transport vehicle to be changed at a branching point, and configured to inspect an installed state of a first travel rail which is one of the travel rails in the pair and the guide rail, the rail inspection device comprising:

a carriage having wheels configured to roll on the travel rails and configured to travel along the first travel rail and the guide rail;

a first roller supported by the carriage to be smoothly movable along the lateral width direction and configured to roll in contact with a side surface of the first rail;

a second roller supported by the carriage to be smoothly movable along the lateral width direction and configured to roll in contact with a side surface of the second rail;

a first position sensor fixedly mounted to the carriage and configured to detect a position, along the lateral width direction, of an outer surface of the first roller;

a second position sensor fixedly mounted to the carriage and configured to detect a position, along the lateral width direction, of an outer surface of the second roller; and at least one rotation sensor provided to the carriage and each configured to detect a rotation angle of one of (a) one of the wheels, (b) the first roller, and (c) the second roller, wherein the first position sensor is fixedly mounted to the carriage so that the first position sensor faces a portion of the outer surface of the first roller symmetrically opposite the portion of the outer surface of the first roller in contact with the side surface of the first rail, and wherein the second position sensor is fixedly mounted to the carriage so that the second position sensor faces a portion of the outer surface of the second roller symmetrically opposite the portion of the outer surface of the second roller in contact with the side surface of the second rail.

2. The rail inspection device as defined in claim 1, further comprising:

a recording portion configured to record, as inspection result information, one of (a) obtained data obtained by the first position sensor and the second position sensor and (b) processed data obtained by processing the obtained data (a), and one of (c) obtained data obtained by the at least one rotation sensor and (d) processed data obtained by processing the obtained data (c), such that the obtained data (a) or the processed data (b) is associated with the obtained data (c) or the processed data (d).

3. The rail inspection device as defined in claim 2, wherein the recording portion records, as the inspection result information, information on a distance between the first travel rail and the guide rail along the lateral width direction at each inspection position, based on a distance between the first travel rail and the guide rail along the lateral width direction calculated from obtained data obtained by the first position sensor and the second position sensor and on a position of the carriage along a direction along which the travel rails extends as an inspection position calculated from obtained data obtained by the at least one rotation sensor.

4. The rail inspection device as defined in claim 1, wherein a centering mechanism is provided to the carriage and is configured to center the carriage with respect to a center position between the travel rails in the pair along the lateral width direction.

5. A rail inspection system comprising:

the rail inspection device as defined in claim 1;

one or more recording portions at least one of which is configured to record, as inspection result information, one of (a) obtained data obtained by the first position sensor and the second position sensor and (b) processed data obtained by processing the obtained data (a), and one of (c) obtained data obtained by the at least one rotation sensor and (d) processed data obtained by processing the obtained data (c), such that the obtained data (a) or the processed data (b) is associated with the obtained data (c) or the processed data (d); and a determining portion configured to determine a presence or non-presence of an abnormal condition in an installed state of the first travel rail and the guide rail based on the inspection result information.

6. The rail inspection system as defined in claim 5, wherein the abnormal condition in the installed state includes variations in manufacturing accuracy of at least one of the first travel rail and the guide rail, and variations in installing accuracy of the first travel rail and the guide rail, and wherein the determining portion: obtains a graph that represents a relationship between data that originate from the at least one rotation sensor and data that originate from the first position sensor and the second position sensor, based on the inspection result information; and makes a distinction between variations in the manufacturing accuracy and variations in the installing accuracy based on a shape of the graph if it is determined that an abnormal condition exists in the installed state.

7. A rail inspection device used in an article transport facility comprising: travel rails forming a pair which are installed such that the travel rails in the pair are spaced apart from each other along the lateral width direction; and a ceiling transport vehicle that travels along the travel rails, and configured to inspect an installed state of a first travel rail which is one of the travel rails in the pair and the second travel rail which is the other of the travel rails in the pair, the rail inspection device comprising:

a carriage having wheels configured to roll on the travel rails and configured to travel along the travel rails in the pair;

a first roller supported by the carriage to be smoothly movable along the lateral width direction and configured to roll in contact with a side surface of the first travel rail;

a second roller supported by the carriage to be smoothly movable along the lateral width direction and configured to roll in contact with a side surface of the second travel rail;

a first position sensor fixedly mounted to the carriage and configured to detect a position, along the lateral width direction, of an outer surface of the first roller;

a second position sensor fixedly mounted to the carriage and configured to detect a position, along the lateral width direction, of an outer surface of the second roller; and at least one rotation sensor provided to the carriage and each configured to detect a rotation angle of one of (a) one of the wheels, (b) the first roller, and (c) the second roller, wherein the first position sensor is fixedly mounted to the carriage so that the first position sensor faces a portion of the outer surface of the first roller symmetrically opposite the portion of the outer surface of the first roller in contact with the side surface of the first travel rail, and wherein the second position sensor is fixedly mounted to the carriage so that the second position sensor faces a portion of the outer surface of the second roller symmetrically opposite the portion of the outer surface of the second roller in contact with the side surface of the second travel rail.

* * * * *